US011380340B2

(12) United States Patent
Nemer et al.

(10) Patent No.: US 11,380,340 B2
(45) Date of Patent: Jul. 5, 2022

(54) SYSTEM AND METHOD FOR LONG TERM PREDICTION IN AUDIO CODECS

(71) Applicant: DTS, Inc., Calabasas, CA (US)

(72) Inventors: Elias Nemer, Irvine, CA (US); Jacek Stachurski, Woodland Hills, CA (US); Zoran Fejzo, Los Angeles, CA (US); Antonius Kalker, Mountain View, CA (US)

(73) Assignee: DTS, Inc., Calabasas, CA (US)

( * ) Notice: Subject to any disclaimer, the term of this patent is extended or adjusted under 35 U.S.C. 154(b) by 0 days.

(21) Appl. No.: 15/700,059

(22) Filed: Sep. 8, 2017

(65) Prior Publication Data

US 2018/0075855 A1 Mar. 15, 2018

Related U.S. Application Data

(60) Provisional application No. 62/385,879, filed on Sep. 9, 2016.

(51) Int. Cl.
*G10L 19/09* (2013.01)
*G10L 19/02* (2013.01)
(Continued)

(52) U.S. Cl.
CPC ..... *G10L 19/09* (2013.01); *G10L 19/0212* (2013.01); *G10L 19/032* (2013.01); *G10L 19/26* (2013.01); *G10L 25/21* (2013.01)

(58) Field of Classification Search
CPC . G10L 19/26; G10L 2019/0011; G10L 19/12; G10L 21/0208; G10L 19/083;
(Continued)

(56) References Cited

U.S. PATENT DOCUMENTS 6,298,322 B1 10/2001 Lindemann
8,738,385 B2 5/2014 Chen
(Continued)

OTHER PUBLICATIONS

International Search Report and Written Opinion in corresponding PCT Application No. PCT/US2017/05845, dated Jan. 12, 2018, 19 pages.

*Primary Examiner* — Huyen X Vo
(74) *Attorney, Agent, or Firm* — Craig S. Fischer

(57) ABSTRACT

A frequency domain long-term prediction system and method for estimating and applying an optimum long term predictor. Embodiments of the system and method include determining parameters of a single-tap predictor using a frequency-domain analysis having an optimality criteria based on spectral flatness measure. Embodiments of the system and method also include determining parameters of the long-term predictor by accounting for the performance of the vector quantizer in quantizing the various subbands. In some embodiments other encoder metrics (such as signal tonality) are used as well. Other embodiments of the system and method include determining the optimal parameters of the long-term predictor by accounting for some of the decoder operation. Other embodiments of the system and method include extending a 1-tap predictor to a k-th order predictor by convolving the 1-tap predictor with a pre-set filter and selecting from a table of such pre-set filters based on a minimum energy criteria.

18 Claims, 12 Drawing Sheets

(51) Int. Cl.
*G10L 19/032* (2013.01)
*G10L 19/26* (2013.01)
*G10L 25/21* (2013.01)

(58) Field of Classification Search
CPC ..... G10L 19/08; G10L 19/18; G10L 21/0232; G10L 25/93; G10L 19/018; G10L 21/038; G10L 25/18; G10L 19/038; G10L 19/10; G10L 13/07; G10L 19/00; G10L 19/04; G10L 19/107; G10L 2019/0008; G10L 2019/0013; G10L 19/09; G10L 19/22; G10L 19/0212; G10L 19/06; G10L 19/07; G10L 2019/0016; G10L 19/0204; G10L 19/20; G10L 25/12; G10L 19/097; G10L 19/16; G10L 19/0208; G10L 19/03; G10L 19/265; G10L 19/24; G10L 21/0264; G10L 25/06; G10L 25/24; G10L 21/02
See application file for complete search history.

(56) References Cited

U.S. PATENT DOCUMENTS

| | | | | |
|---|---|---|---|---|
| 2005/0137863 | A1* | 6/2005 | Jasiuk | G10L 19/09 704/222 |
| 2010/0286980 | A1 | 11/2010 | Jasiuk et al. | |
| 2010/0286991 | A1* | 11/2010 | Hedelin | G10L 19/035 704/500 |
| 2013/0282383 | A1 | 10/2013 | Hedelin et al. | |
| 2016/0104490 | A1 | 4/2016 | Fraunhofer-Gesellschaft et al. | |

* cited by examiner

SYSTEM AND METHOD FOR LONG TERM PREDICTION IN AUDIO CODECS

BACKGROUND

Increasing coding gain by exploiting the redundancy of an audio signal is a fundamental concept in audio codecs. Audio signals exhibit varying degree of redundancy including long-term redundancy (or periodicity) and short term redundancy, which is found mostly in speech signals. FIG. 1 illustrates the concepts behind the long-term and short-term predictions of an audio signal. Removing or reducing such redundancy results in a reduction of the number of bits needed to code the residual signal (as compared to coding the original signal). Speech codecs typically include predictors to remove both types of redundancy and to maximize coding gain. Transform-based codecs are designed for the general audio signal and typically make no assumptions about its origins. They focus mainly on the long-term redundancy. In transform codecs the residual signal yields a transform vector that has lower energy and is sparser. This makes it easier for the quantization scheme to represent the transform coefficients efficiently.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Embodiments of the frequency domain long-term prediction system and method described herein include novel techniques for estimating and applying an optimum long term predictor in the context of an audio codec. In particular, embodiments of the system and method include determining parameters (such as Lag and Gain) of a single-tap predictor using a frequency-domain analysis having an optimality criteria based on spectral flatness measure. Embodiments of the system and method also include determining parameters of the long-term predictor by accounting for the performance of the vector quantizer in quantizing the various subbands. In other words, by combining the vector quantization error with the spectral flatness. In some embodiments other encoder metrics (such as signal tonality) are used as well. Other embodiments of the system and method include determining the optimal parameters of the long-term predictor by accounting for some of the decoder operation, such as the reconstruction errors of the predictor and synthesis filters. In some embodiments this is performed in lieu of doing a full analysis-by-synthesis (as in some classical approaches). Yet other embodiments of the system and method include extending a 1-tap predictor to a k-th order predictor by convolving the 1-tap predictor with a pre-set filter and selecting from a table of such pre-set filters based on a minimum energy criteria.

Embodiments include an audio coding system for encoding an audio signal. The system includes a long-term linear predictor having an adaptive filter used to filter the audio signal and adaptive filter coefficients used by the adaptive filter. The adaptive filter coefficients are determined based on an analysis of a windowed time signal of the audio signal. Embodiments of the system also include a frequency transformation unit that represents the windowed time signal in a frequency domain to obtain a frequency transformation of the audio signal, and an optimal long-term predictor estimation unit that estimates an optimal long-term linear predictor based on an analysis of the frequency transformation and a criteria of optimality in the frequency domain. Embodiments of the system further include a quantization unit that quantizes frequency transform coefficients of a windowed frame to be encoded to generate quantized frequency transform coefficients, and an encoded signal containing the quantized frequency transform coefficients. The encoded signal is a representation of the audio signal.

Embodiments also include a method for encoding an audio signal. The method includes filtering the audio signal using a long-term linear predictor, wherein the long-term linear predictor is an adaptive filter, and generating a frequency transformation for the audio signal. The frequency transform represents a windowed time signal in a frequency domain. The method further includes estimating an optimal long-term linear predictor based on an analysis of the frequency transformation and a criteria of optimality in the frequency domain, and quantizing frequency transform coefficients of a windowed frame to be encoded to generate quantized frequency transform coefficients. The method also includes constructing an encoded signal containing the quantized frequency transform coefficients, wherein the encoded signal is a representation of the audio signal.

Other embodiments include a method for extending a 1-tap predictor filter to a k-th order predictor filter during encoding of an audio signal. This method includes convolving the 1-tap predictor filter with a filter shape chosen from a predictor filter shapes table containing pre-computed filter shapes to obtain a resulting k-th order predictor filter. The method also includes running the resulting k-th order predictor filter on the audio signal to obtain an output signal, and computing an energy of the output signal of the resulting k-th order predictor filter. The method further includes selecting an optimal filter shape from the table that minimizes the energy of the output signal, and applying the resulting k-th order predictor filter containing the optimal filter shape to the audio signal.

It should be noted that alternative embodiments are possible, and steps and elements discussed herein may be changed, added, or eliminated, depending on the particular embodiment. These alternative embodiments include alternative steps and alternative elements that may be used, and structural changes that may be made, without departing from the scope of the invention.

DRAWINGS DESCRIPTION

Referring now to the drawings in which like reference numbers represent corresponding parts throughout:

DETAILED DESCRIPTION

In the following description of embodiments of a frequency domain long-term prediction system and method reference is made to the accompanying drawings. These drawings shown by way of illustration specific examples of how embodiments of the frequency domain long-term prediction system and method may be practiced. It is understood that other embodiments may be utilized and structural changes may be made without departing from the scope of the claimed subject matter.

I. General Overview

In the classical approaches, the predictor coefficients are determined by a time-domain analysis. This typically involves minimizing the energy of the residual signal. This translates into searching for the lag (L) that maximizes the normalized autocorrelation function over a given analysis time-window. Solving a matrix system of equations yields the predictor gains. The size of the matrix is function of the order (k) of the filter. In order to reduce the size of matrix, it is often assumed that the side taps are symmetric. For example, this would reduce the matrix size from a size-3 to a size-2 or a size-5 to a size-3.

In practical audio codecs estimating the lag (or periodicity of the signal) based on time-domain autocorrelation methods requires special care. Some common problems with these techniques are pitch-doubling and halving. These can have a significant impact on the perceptual performance or coding gain. In order to mitigate these shortcomings, a number of alternative approaches and heuristics are often employed. These include, for example, using the cepstral analysis or exhaustively searching all possible multiples. For higher-order predictors, estimating the multiple taps requires an inverse matrix operation that in practice is not guaranteed. Thus, it is often desirable to estimate the center tap (L) only and then find a way to select the side taps from a limited sets based on some criteria of optimality.

Open-Loop Vs. Closed-Loop Architectures

Figure 1:
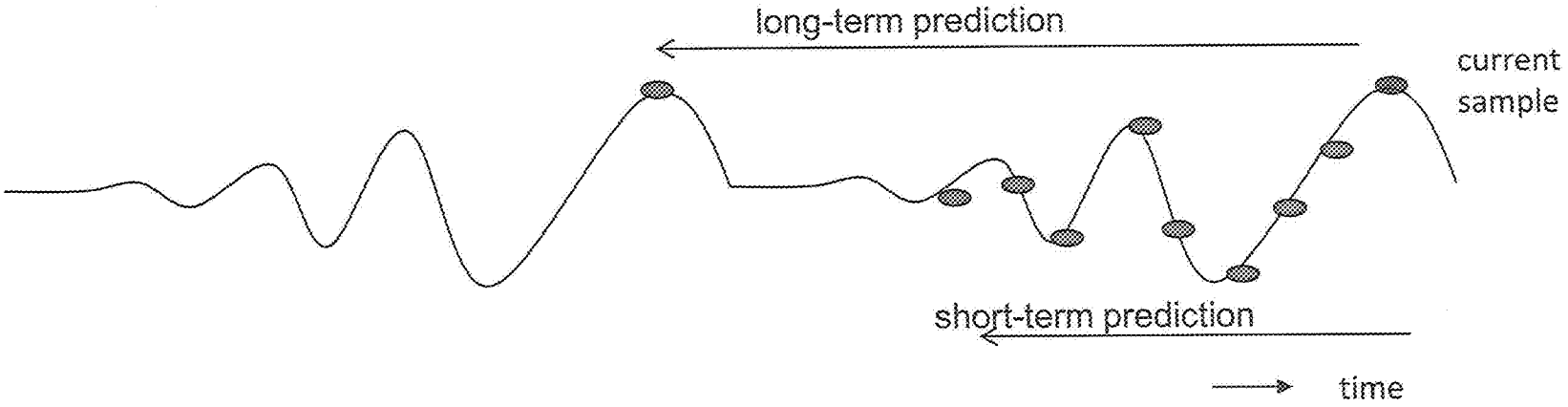
FIG. 1 illustrates the concepts behind the long-term and short-term predictions of an audio signal.
Figure 2:
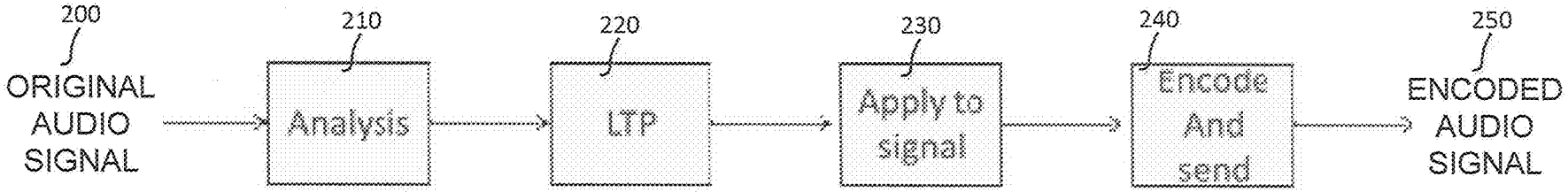
FIG. 2 is a block diagram illustrating the general operation of an open-loop approach.

In open-loop approaches the estimation of the predictor is done with an analysis of the original (un-coded) signal. FIG. 2 is a block diagram illustrating the general operation of an open-loop approach. The approach inputs an original audio signal 200 and performs an analysis of the original audio signal (box 210). Next, optimal long-term predictor (LTP) parameters are selected based on some criteria (box 220). These selected parameters applied to the signal (box 230) and the resultant signal is encoded and sent out (box 240). The resultant signal is an encoded audio signal 250, which is an encoded representation of the original audio signal 200.

Figure 3:
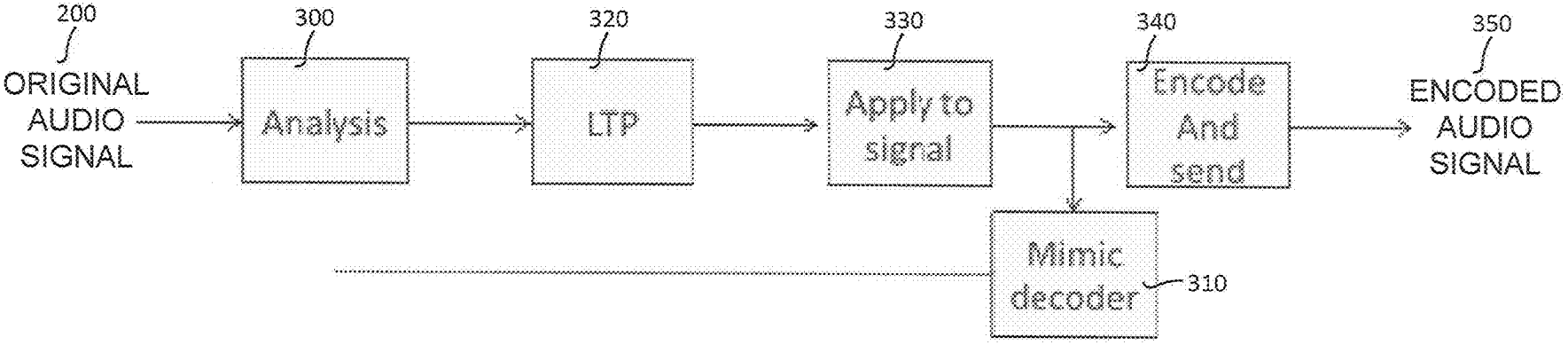
FIG. 3 is a block diagram illustrating the general operation of a closed-loop approach.

In closed-loop approaches the encoder replicates some or all of the operations of the decoder and resynthesizes the signal for each of the possible choice of parameters. FIG. 3 is a block diagram illustrating the general operation of a closed-loop approach. Similar to the open-loop approach, the closed-loop approach inputs the original audio signal 200 and performs an analysis of the original audio signal (box 300). This analysis includes simulating or mimicking the decoder (box 310) corresponding to the encoder. Optimal long-term predictor (LTP) parameters are selected based on some criteria (box 320) and these selected parameters applied to the signal (box 330). The selection of the optimal long-term predictor parameters is based on which ones minimize a perceptually-weighted error between the 'decoded' signal and the original audio signal 200. The resultant signal is encoded and sent out (box 340). The resultant signal is an encoded audio signal 350, which is an encoded representation of the original audio signal 200.

Long-Term Predictors in Transform-Based Audio Codecs

Transform-based audio codecs typically use a Modified Discrete Cosine Transform (MDCT) or other type of frequency transformation to encode and quantize a given frame of audio. The phrase "transform-based" used herein also includes the subband-based or lapped-transform based codecs. Each of these involves some form of frequency transform but may be with or without window overlapping, as persons skilled in the art would appreciate.

Figure 4:
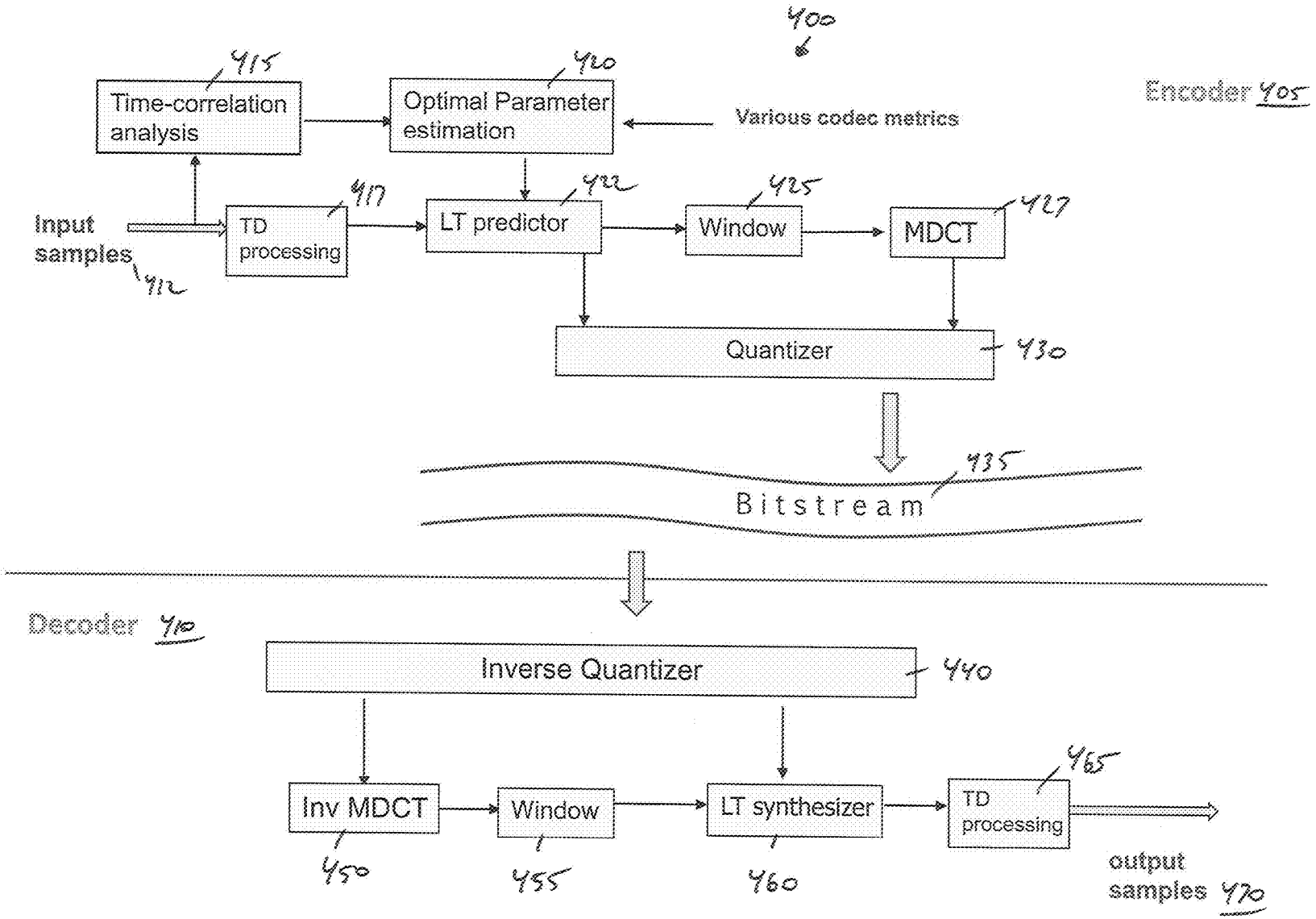
FIG. 4 is a block diagram illustrating an exemplary use of a long-term predictor in a transform-based audio codec.

FIG. 4 is a block diagram illustrating an exemplary use of a long-term predictor in a transform-based audio codec. The long-term predictor is applied to the time domain signal prior to windowing and frequency transformation. Referring to FIG. 4, the transform-based audio codec 400 includes an encoder 405 and a decoder 410. Input samples 412 corresponding to an audio signal are received by the encoder 405. A time-correlation analysis block 415 estimates the periodicity of the audio signal. Other time-domain processing 417, such as high-pass filtering, may be performed on the signal.

Based on the analysis of the time-correlation analysis block 415, the optimal parameters of the long-term predictor are estimated by the optimal parameter estimation block 420. This estimated long-term predictor 422 is output. The long-term predictor is a filter and these parameters can be applied to the data coming from the time-domain processing block 417.

A windowing function 425 and various transforms (such as an MDCT 427) are applied to the signal. A quantizer 430 quantizes the predictor parameters and the MDCT coefficients using various scalar and vector quantization techniques. This quantized data is prepared and output from the encoder 405 as a bitstream 435.

The bitstream 435 is transmitted to the decoder 410 where operations inverse to the encoder 405 occur. The decoder includes an inverse quantizer 440 that recovers the quantized data. This includes the inverse MDCT coefficients 450 and prediction parameters converted into the time domain. Windowing 455 is applied to the signal and a long-term synthesizer 460, which is an inverse filter to the long-term predictor on the encoder 405 side, is applied to the signal. An inverse time-domain processing block 465 performs inverse processing of any filtering performed by the time-domain processing block 417 at the encoder 405. The output of the decoder 410 are output samples 470 corresponding to the decoded input audio signal. This decoded audio signal may be played back over loudspeakers or headphones.

In open-loop architectures the estimation of the optimal predictor is done based on some analysis of the time signal and possibly accounting for other metrics from the encoder. The lag (L) is estimated based on maximizing the normalized autocorrelation of the original time signal. Moreover, the predictor filter contains 2 taps (B1 and B2), which are estimated based on functions of the value of the autocorrelation at L and L+1. Various other details may also be provided, such as center-clipping of the time signal and so forth.

Another example of an open-loop architecture is where the term pre-filter and post-filter are used to refer to the long term predictor filter and synthesis filter, respectively. The difference in this approach is that the long term predictor (both the estimation as well as the filtering) is removed from the rest of the encoder and decoder. Therefore, the estimation of the parameters is independent of the mode of operation of the encoder and is based only on the analysis of the original time signal. The output of the long-term prediction filter (called a pre-filter) is sent to the encoder. The encoder may be of any type and running at any bitrate. Similarly, the output of the decoder is sent to the long-term prediction synthesis filter (called post-filter), which operates independently of the decoder mode of operation.

Figure 5:
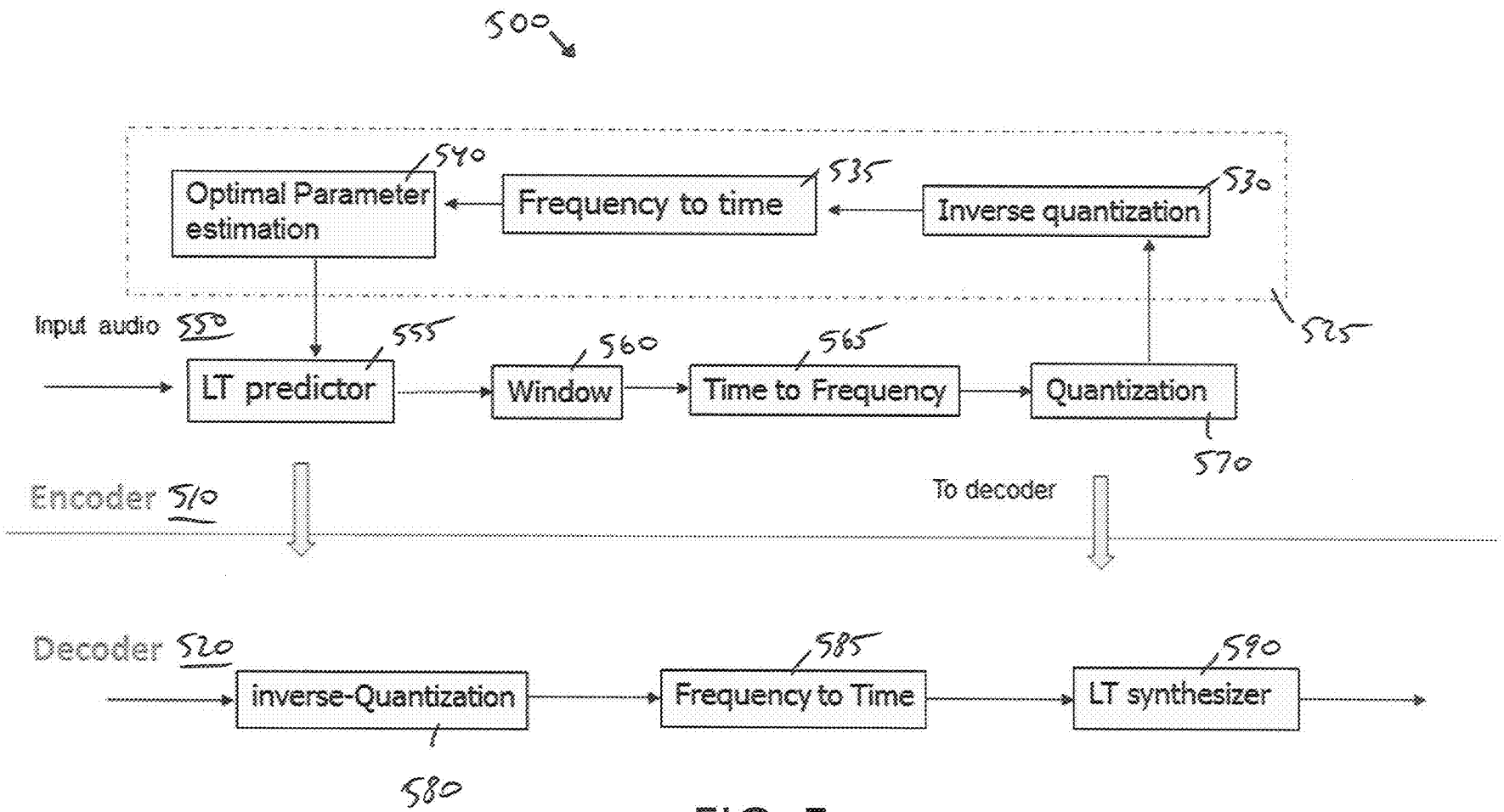
FIG. 5 illustrates an exemplary example of closed-loop architecture.

In closed-loop architectures, some (or all) parts of the decoder operations are replicated at the encoder in order to provide a more accurate estimation of the cost or optimization function. The predictor coefficients are computed based on some maximizing criteria. In addition, a feedback loop is used to refine the choices based on an analysis-by-synthesis approach. FIG. 5 illustrates one example of closed-loop architecture. Such an approach is where a full inverse quantization and inverse frequency transformation is recreated at the encoder in order to resynthesize the time samples (that the decoder would have produced). These samples are then used in the optimal estimation of the LTP coefficients.

Referring to FIG. 5, a closed-loop architecture-based codec 500. This codec includes an encoder 510 and a decoder 520. A mimic decoder 525 is used in a feedback loop to replicate the decoder 520 on the encoder 510 side. This mimic decoder 525 includes an inverse quantization block 530 that generates the frequency coefficients. These coefficients then are converted back into the time domain by the frequency-to-time block 535. The output of the block 535 is decoded time samples. An optimal parameter estimation block 540 compares decoded time samples to input time samples 550. The block 540 then generates an optimal set of long-term predictor parameters 555 that minimize the error between the input time samples 540 and the decoded time samples.

A windowing function 560 applies windows to the time signal and a time-to-frequency block 565 transforms the signal from the time domain into the frequency domain. A quantization block 570 quantizes the predictor parameters and the frequency coefficients using various scalar and vector quantization techniques. This quantized data is prepared and output from the encoder 510.

The decoder 520 includes an inverse quantization block 580 that recovers the quantized data. This quantized data (such as the frequency coefficients and prediction parameters) are converted into the time domain by a frequency-to-time block 585. A long-term synthesizer 590, which is an inverse filter to the long-term predictor on the encoder 510 side, is applied to the signal.

II. System and Operational Overview

Embodiments of the frequency domain long-term prediction system and method described herein include techniques for estimating and applying an optimum long term predictor in the context of an audio codec. In transform codecs, the coefficients of the frequency transform (such as MDCT), and not the time-domain samples, are the ones that are vector quantized. Therefore, it is appropriate to search for the optimal predictor in the transform domain, and based on a criteria that improves the quantization of these coefficients.

Embodiments of the frequency domain long-term prediction system and method include using the spectral flatness of the various subbands as the criteria or measure. In typical codecs, the spectrum is divided in bands according to some symmetric or perceptual scale and the coefficients of each band are vector-quantized based on a minimum mean-square error (or minimum mse) criteria.

Figure 6:
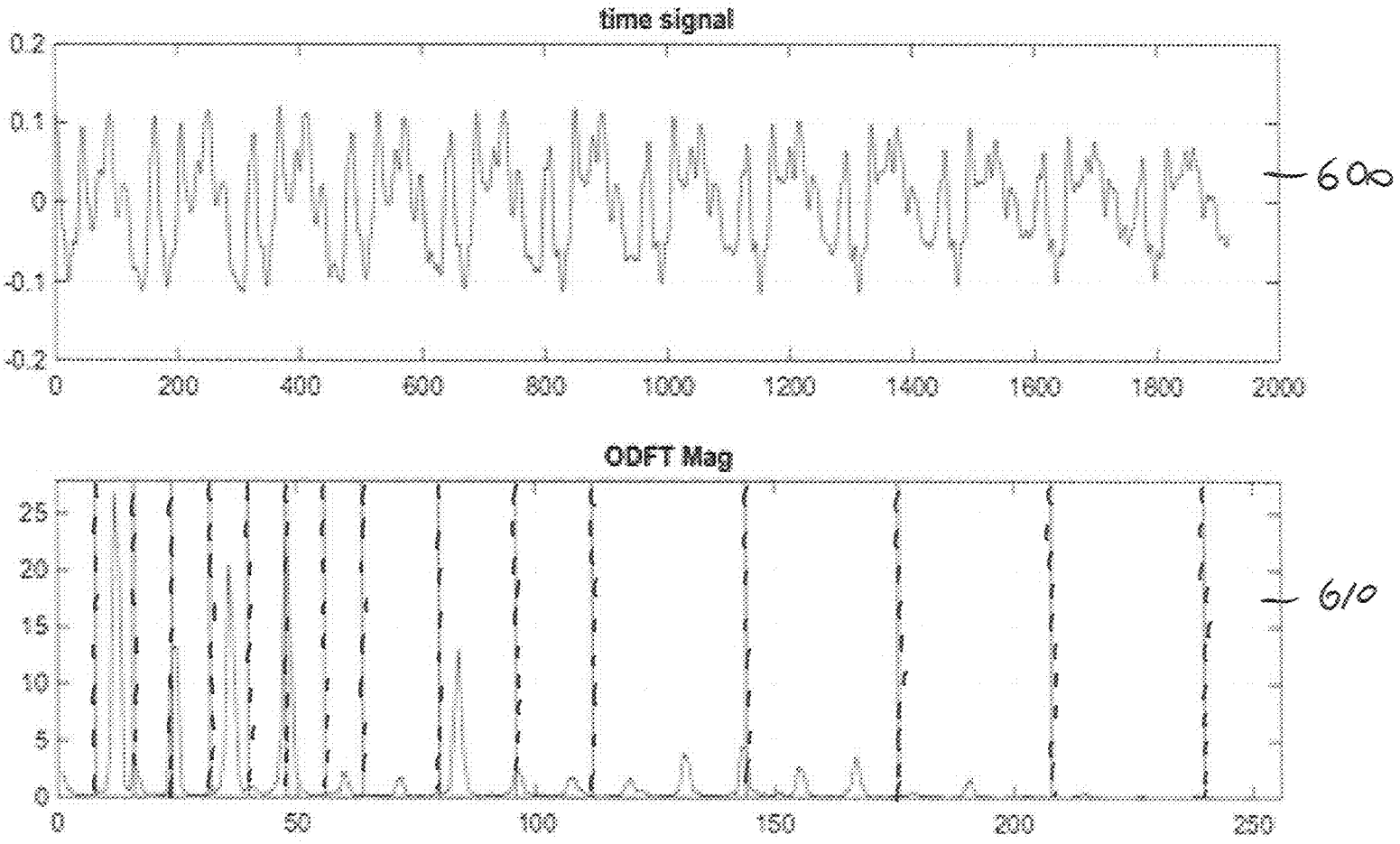
FIG. 6 illustrates the time and frequency transform of a segment of a harmonic audio signal.

The spectrum of a tonal audio signal has a pronounced harmonic structure with peaks at the various tonal frequencies. FIG. 6 illustrates the time and frequency transform of a segment of a harmonic audio signal. Referring to FIG. 6, the first graph 600 is a window (or segment) of a tonal audio signal. The second graph 610 illustrates the corresponding frequency-domain magnitude spectrum of the tonal audio signal shown in the first graph 600. The vertical dashed lines in the second graph 610 illustrate the boundaries of typical frequency bands on a perceptual scale, as commonly used in audio coding.

When considering one band at a time, one or two dominant peaks are likely present in addition to some non-harmonic smaller values. Thus, the flatness measure of that band is low. The vector quantization based on a minimum-mean square error will favor the high peaks as these contribute more to the error norm than the lower values. Depending on the available bits, the VQ may miss the smaller coefficients in that band, thus resulting in high quantization noise.

Some embodiments of the frequency domain long-term prediction system and method select an optimal lag for the long term predictor based at least on maximizing the flatness measure across the bands of the spectrum. Similarly, in some embodiments the gain of the predictor for a given optimum lag takes into account the quantization error of the vector quantizer. This is based on the observation that a large prediction gain can results in significantly attenuating the weaker frequency coefficients. In low bitrates, and particularly for strongly harmonic signals, this can result in some of the weaker harmonics being completely missed out by the vector quantizer, resulting in perceived harmonic distortion. Therefore, the gain of the predictor is made a function of at least the quantization error of the vector quantizer.

Embodiments of the frequency domain long-term prediction system and method include techniques for estimating and applying an optimum long term predictor in the context of an audio codec is detailed below. Some embodiments determine the Lag and Gain parameters of a single-tap predictor using a frequency-domain analysis. In these embodiments an optimality criteria is based on spectral flatness measure. Some embodiments determine the long-term predictor parameters by accounting for the performance of the vector quantizer in quantizing the various subbands. In other words, these embodiments combine the vector quantization error with the spectral flatness as well as other encoder metrics (such as signal tonality). Some embodiments of the system and method determine optimal parameters of the long-term predictor by taking into account some of the decoder operation, including the reconstruction errors of the predictor and synthesis filters. This avoids performing a full analysis-by-synthesis as in some classical approaches. Some embodiments extend a 1-tap predictor to a k-th order predictor by convolving the 1-tap predictor with a pre-set filter and selecting from a table of such pre-set filters based on a minimum energy criteria.

III. System and Operational Details

The details of the frequency domain long-term prediction system and method will now be discussed. It should be noted that many variations are possible and that one of ordinary skill in the art will see many other ways in which the same outcome can be achieved based on the disclosure herein.

Definitions

In its basic form, the prediction error signal is given by:

$$d(n)=s(n)-bs(n-L)$$

where "s(n)" is the input audio signal, "L" is the signal periodicity (or lag (L)), and "b" is the predictor gain.

The predictor can be expressed as a filter whose transfer function is given by:

$$H_{LT\text{-}pre}(z)=1-bz^{-L}.$$

The generalized form for any order (K) can be expressed as:

$$H_{LT-pre}(z) = 1 - \sum_{k=-K}^{K} b(k)z^{-(L+k)}.$$

Frequency-Based Optimality Criteria

Figure 7:
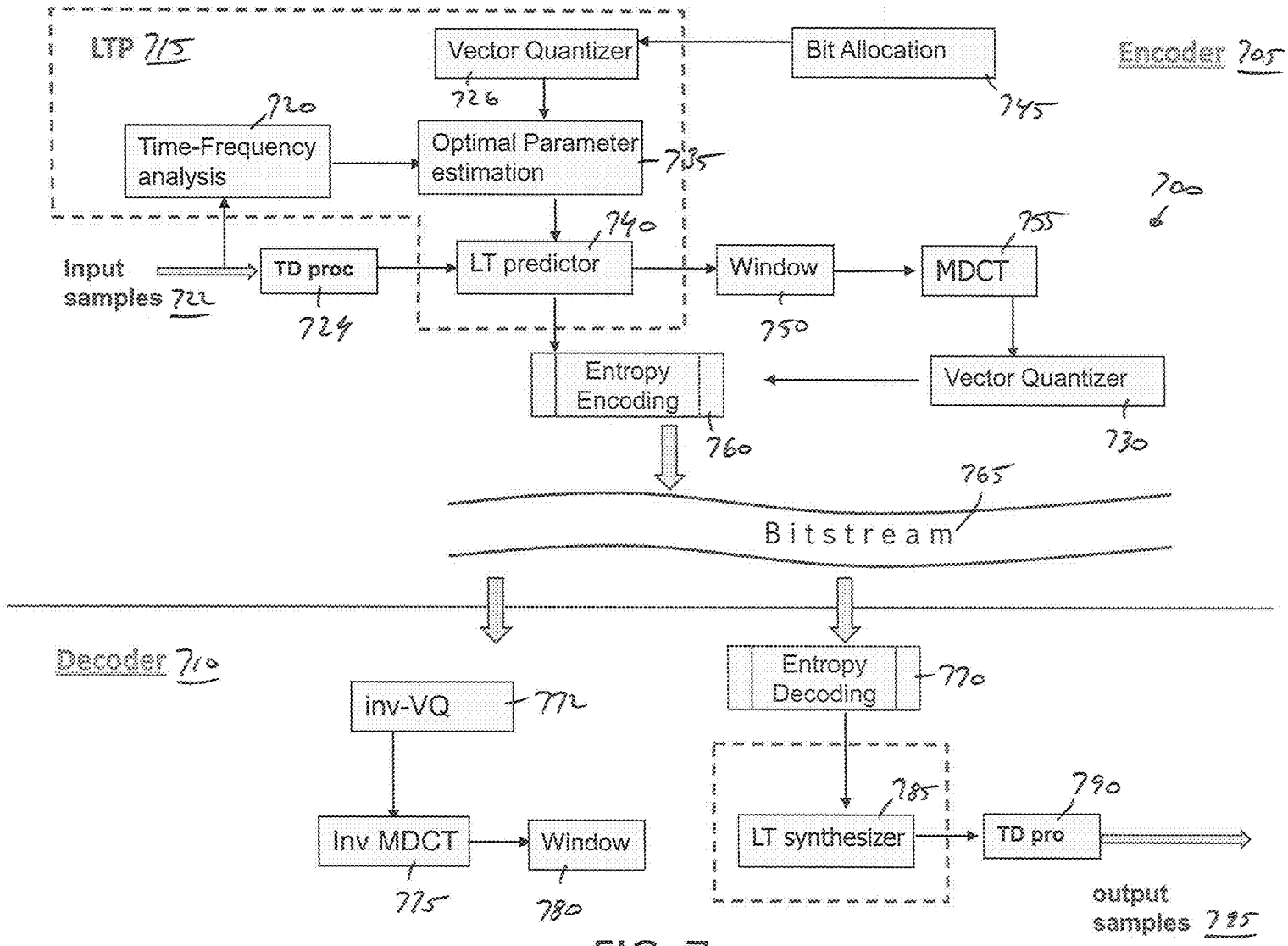
FIG. 7 is a general block diagram of embodiments of the frequency domain long-term prediction system and method.

FIG. 7 is a general block diagram of embodiments of the frequency domain long-term prediction system 700 and method. The system 700 includes both an encoded 705 and a decoder 710. It should be noted that the system 700 shown in FIG. 7 is an audio codec. However, other implementations of the method are possible including other types of codecs that are not an audio codec.

As shown in FIG. 7, the encoder 705 includes a long-term prediction (LTP) block 715 that generates a long-term predictor. The LTP block 715 includes a time-frequency analysis block 720 that performs a time-frequency analysis on input samples 722 of an input audio signal. The time-frequency analysis involves applying a frequency transform, such as the ODFT, and then computing the flatness measure of the ODFT magnitude spectrum based on some subband division of that spectrum.

The input samples 722 are also used by a first time-domain (TD) processing block 724 to perform time-domain processing of the input samples 722. In some embodiments the time-domain processing involves using a pre-emphasis filter. A first vector quantizer 726 is used to determine an optimal gain of the long-term predictor. This first vector quantizer is used in parallel with a second vector quantizer 730 to determine the optimal gain.

The system 700 also includes an optimal parameter estimation block 735 that determines the coefficients of the long-term predictor. This process is described below. The result of this estimation is a long-term predictor 740, which is an actual long-term predictor filter of a given order K.

A bit allocation block 745 determines the number of bits assigned to each subband. A first window block 750 applies various window shapes to the time signal prior to transformation to the frequency domain. A modified discrete cosine transform (MDCT) block 755 is an example of one of type frequency transformation used in typical codecs that transforms the time signal into the frequency domain. The second vector quantizer 730 represents vector of MDCT coefficients into vectors taken from a codebook (or some other compacted representation).

An entropy encoding block 760 takes the parameters and encodes them into an encoded bitstream 765. The encoded bitstream 765 is transmitted to the decoder 710 for decoding. An entropy decoding block 770 extracts all parameters from the encoded bitstream 765. An inverse vector quantization block 772 reverses the process of the first quantizer 726 and the second vector quantizer 730 of the encoder 705. An inverse MDCT block 775 is an inverse transformation to the MDCT block 755 used at the encoder 705.

A second window block 780 performs a windowing function similar to the first windowing block 750 used in the encoder 705. A long-term synthesizer 785 is an inverse filter of the long-term predictor 740. A second time-domain (TD) processing block 790 counters the processing applied at the encoder 705 (such as de-emphasis). The output of the decoder 710 is output samples 795 corresponding to the decoded input audio signal. This decoded audio signal may be played back over loudspeakers or headphones.

Figure 8:
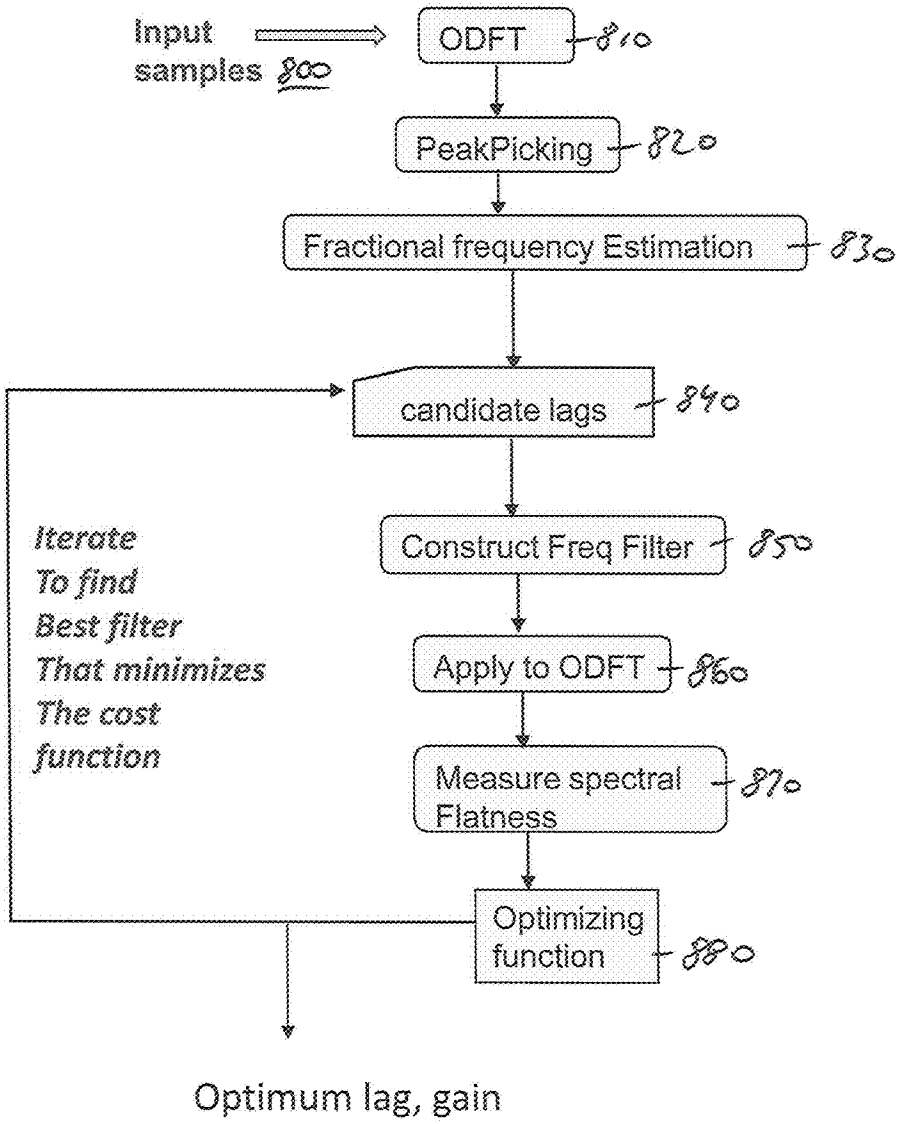
FIG. 8 is a general flow diagram of embodiments of the frequency domain long-term prediction method.

FIG. 8 is a general flow diagram of embodiments of the frequency domain long-term prediction method. FIG. 8 sets forth the various operations performed in order to generate optimal parameters of the long-term predictor. Referring to FIG. 8, the operation begins by receiving input samples 800 of an input audio signal. Next, an odd-DFT (ODFT) transform is applied (box 810) to a windowed section of the signal, spanning 'N' points. The transform is defined as:

$$X(k) = \sum_{n=0}^{N-1} x(n)\cdot w(n)\cdot e^{-j\frac{2\pi}{N}(k+\frac{1}{2})n}. \tag{1}$$

Where 'k' and 'n' are the frequency and time indices respectively and 'N' is the length of the sequence. Prior to applying the transform, a sine window [1] is applied to the time signal:

$$w(n) = \sin\frac{\pi}{N}\left(n+\frac{1}{2}\right). \tag{2}$$

The method then performs peak picking (box 820). Peak picking encompasses identifying the peaks in the magnitude spectrum that corresponds to the frequencies of the sinusoidal components in the time signal. A simple scheme of peak picking involving locating the local maximums above a certain height, and imposing certain condition on the relative relation to the neighboring peaks. A given bin 'lo' is considered a peak, if it is an inflection point:

$$|X(lo-1)|\leq X(lo)|\geq |X)lo+1)| \tag{3}$$

that is above a certain threshold $$|X(lo)|>\text{Thr} \tag{4}$$

And higher than its next neighbors:

$$|X(lo)|>\beta\cdot\max\{|X(lo-1)|,\ |X(lo+1)|\} \tag{5}$$

The signal is searched for peaks that correspond to the frequency interval of [50 Hz:3 kHz]. The value for 'Thr' can be chosen relative to the maximum value of X(k).

The next operation is fractional frequency estimation (box 830). A lag 'L' in the time domain may be represented by a corresponding peak in the frequency domain. Once a peak ('lo' in bins) is identified, the fractional frequency ('dl') needs to be estimated. There are various ways to do this. Once possible scheme is to assume that the sinusoid that gave rise to this peak is modeled in the time domain as:

$$x(n) = A_p \cdot \sin\left[\frac{2\pi}{N}(lo + \Delta l)n + \phi_p\right]. \tag{6}$$

The fractional frequency of the frequency peak (lo) is then estimated by considering the ratio of the magnitudes around the bin 'lo, using the following:

$$\Delta l \approx \frac{3}{\pi}\arctan\left[\frac{\sqrt{3}}{2 \cdot \sqrt[G]{\frac{|X(lo-1)|}{|X(lo+1)|}} + 1}\right]. \tag{7}$$

Where G is a constant that can be set to a fixed value, or computed based on the data.

All the lags (lo+dl) that falls within the frequency interval of [50 Hz:3 kHz] are considered (box 840), and their normalized autocorrelation is computed. This computation is based on the time domain equivalent lag (L):

$$NR(L) = \frac{R[0, L]}{R[L, L]} \text{ with } R[i, j] = \sum_{n=0}^{N} x(n-i) \cdot x(n-j) \tag{8}$$

and x(n) is the input time signal. Those lags whose normalized correlation value is greater than a given threshold, are kept, and become the set of candidate lags.

The method proceeds with constructing a frequency filter (or prediction filter) in the frequency domain (box 850). In order to apply the filter (for a given time lag 'L' and gain 'b') to the ODFT magnitude points, the frequency response function of that filter is derived. Consider the z-transform of a single-tap predictor:

$$h(z)=1-bz^{-L} \tag{9}$$

with $z=e^{j\omega}$ and $$w = \frac{2\pi}{N}k,$$

yields:

$$h(k) = 1 - be^{-j\frac{2\pi}{N}kL} \tag{10}$$

For a given frequency peak ('lo' in bins), and its fractional frequency (dl), the time lag 'L' can be written in terms of frequency units as:

$$L = \frac{N}{lo + \Delta l} \tag{11}$$

the magnitude response of the predictor filter based on this peak is thus:

$$|h(k)| = \sqrt{(1 + b^2) - 2b\cos\left(\frac{2\pi}{lo + \Delta l}k\right)}. \tag{12}$$

Next, the filter is applied to the ODFT spectrum (box 860). Specifically, the filter computed above is then applied directly to the ODFT spectrum S(k) points to yield a new filtered ODFT spectrum X(k).

$$X(k)=|h(k)|\cdot S(k) \quad k=0, \ldots, K-1 \tag{13}$$

The method then computes a spectral measure of flatness (box 870). The spectral measure of flatness is computed on the ODFT magnitude spectrum of the filtered spectrum after applying the candidate filter to the original spectrum. Any generally accepted measure of spectral flatness can be used. For instance, an entropy-based measure may be used. The spectrum is divided into perceptual bands (for instance according to a Bark scale) and the flatness measure is computed for each band (n) as:

$$\text{Log}[F_n(X) + 1] = -\frac{1}{\log(K)}\hat{X}(k)\log\left[\hat{X}(k)\right] \tag{14}$$

Where the normalized value of the magnitude at bin 'k' is:

$$\hat{X}(k) = \frac{X(k)}{\sum_{k=0}^{K-1} X(k)} \tag{15}$$

And 'K' is the total number of bins in the band.

Next, the method uses an optimizing function (box 880) and iterates to find the long-term predictor (or filter) that minimizes the optimizing (or cost) function. A simple optimizing function consists of a single flatness measure for the entire spectrum. The linear values of the spectral flatness measure $F_n(X)$ are then averaged across all the bands to yield a single measure:

$$\overline{F} = \frac{1}{B}\sum_{n=0}^{B} F_n(X) \cdot W_n(X) \tag{16}$$

Where 'B' is the number of bands. $W_n(X)$ is a weighting function that emphasizes certain bands more than others, based on energy, or simply their order on the frequency axis.

Figure 9:
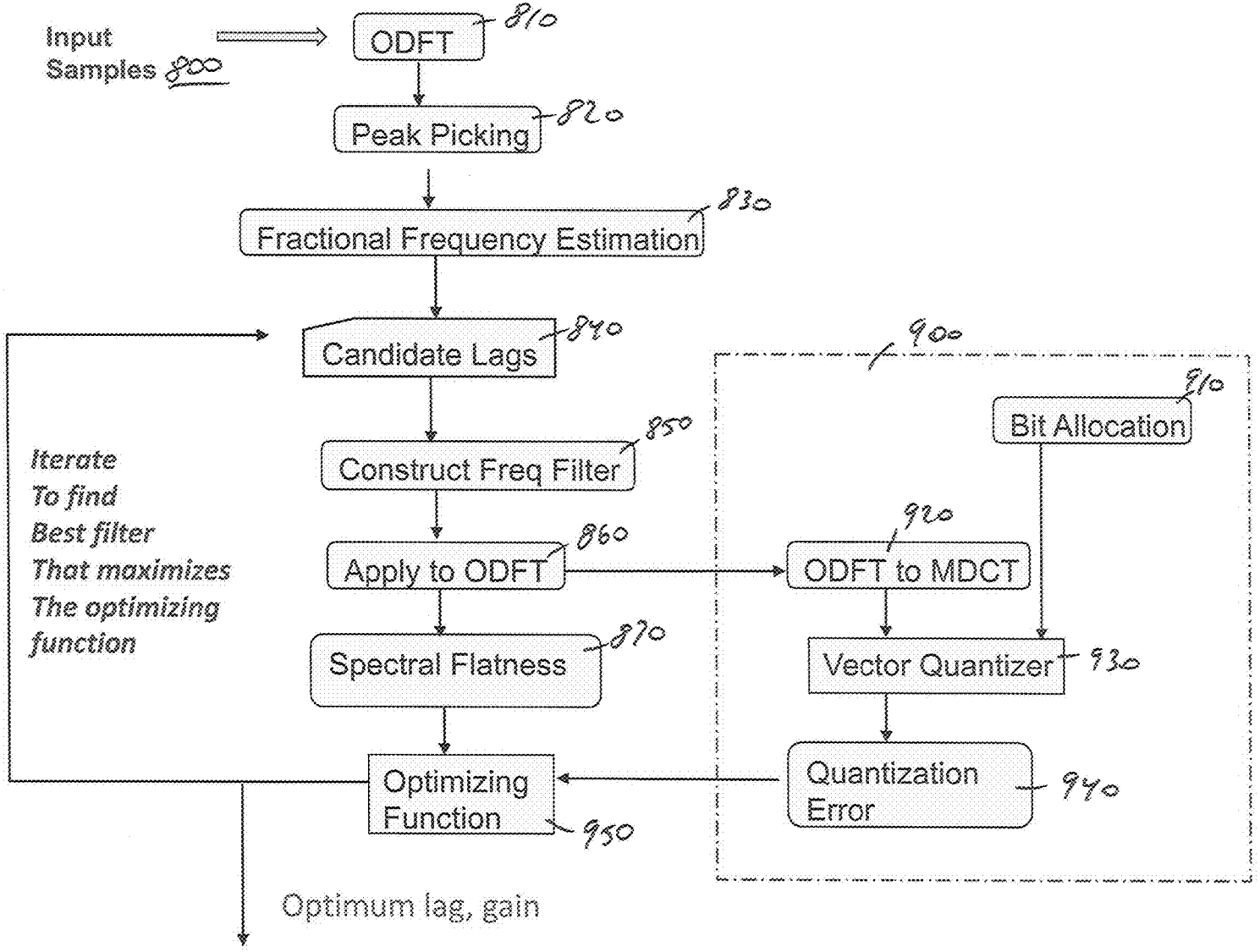
FIG. 9 is a general flow diagram of other embodiments of the frequency domain long-term prediction method that use a combined frequency-based criteria with other encoder metrics.

Embodiments Using Combined Frequency-Based Criteria with Other Encoder Metrics FIG. 9 is a general flow diagram of other embodiments of the frequency domain long-term prediction method that use a combined frequency-based criteria with other encoder metrics. In these alternate embodiments the VQ quantization error, and possibly other metrics like the frame tonality, are accounted for when determining the optimization function. This is done to account for the effect of the long-term predictor (LTP) on the VQ operation. There are a number of ways to combine the VQ error with the flatness measure, as detailed below.

In these embodiments the ODFT spectrum is first converted to an MDCT spectrum. Next, the VQ is applied to the individual bands in that MDCT spectrum. The bit allocations used are derived from another block in the encoder.

Referring to FIG. 9, the operation of boxes 810, 820, 830, 840, 850, 860, and 870 are discussed above with respect to FIG. 8. The block 900 outlines the additions to the method in these embodiments. The block 900 includes a bit allocation (box 910) that is performed and includes various schemes used in the codec to allocate bits across subbands based on a variety of criteria.

The method then performs an ODFT to modified discrete cosine transform (MDCT) conversion (box 920). Specifically, the ODFT spectrum is converted to an MDCT spectrum using the relation:

$$X_M(k) = \mathrm{Re}\lfloor X_0(k) \cdot e^{-j\phi} \rfloor \tag{17}$$

$$\phi = \frac{2\pi}{N}\left(k + \frac{1}{2}\right)\left(\frac{1}{2} + \frac{N}{4}\right) \tag{18}$$

and $X_0(k)$ is the ODFT spectral value.

Next, the method applies a vector quantization (box 930) to the MDCT spectrum, using the bit allocation budget computed at the encoder. Each subband is quantized as a vector or a series of vectors. The result is a quantization error (box 940). The method then combines the flatness measure with the VQ error to apply an optimizing function (box 950). In particular, the optimization function is derived by combining the flatness measure with a weighting based on the VQ error. The method iterates to find the filter parameters that minimize the combination optimization (or cost) function.

In some embodiments, the VQ error for each subband is used as a weighting function to emphasize certain bands more than others. Thus, the flatness is weighted and then averaged:

$$\overline{F} = \frac{1}{B}\sum_{n=0}^{B} F_n(X) \cdot W_n(X), \tag{19}$$

where $W_n(X)$ is function of the VQ error for the nth band in the MDCT.

In another embodiment, the VQ error is used to select the optimum gain. The gain associated with a given lag 'L' is computed from the normalization autocorrelation function NR(L). Once the optimum lag is determined (based on the flatness measure), the corresponding gain is iteratively scaled down or up, by a factor in order to minimize the VQ (weighted) quantization error.

In alternate embodiments the VQ error is be used to create an upper limit for the gain. This is for embodiments where a very high gain could cause certain sections of the spectrum to go below the floor at which the VQ will quantize them. The situation occurs during low bit rates, when the VQ error is high, and is particularly pronounced in highly tonal content. Thus an upper bound for the gain in frame 'n' is determined as function of the frame tonality and the average VQ error. Mathematically, this is given as:

$$\mathrm{GainLimit}(n) = \mathrm{Fct}\{\mathrm{Tonality}(n), VQ\mathrm{err}(n)\}.$$

Embodiments with Optimization Criteria with Decoder Reconstruction

Figure 10:
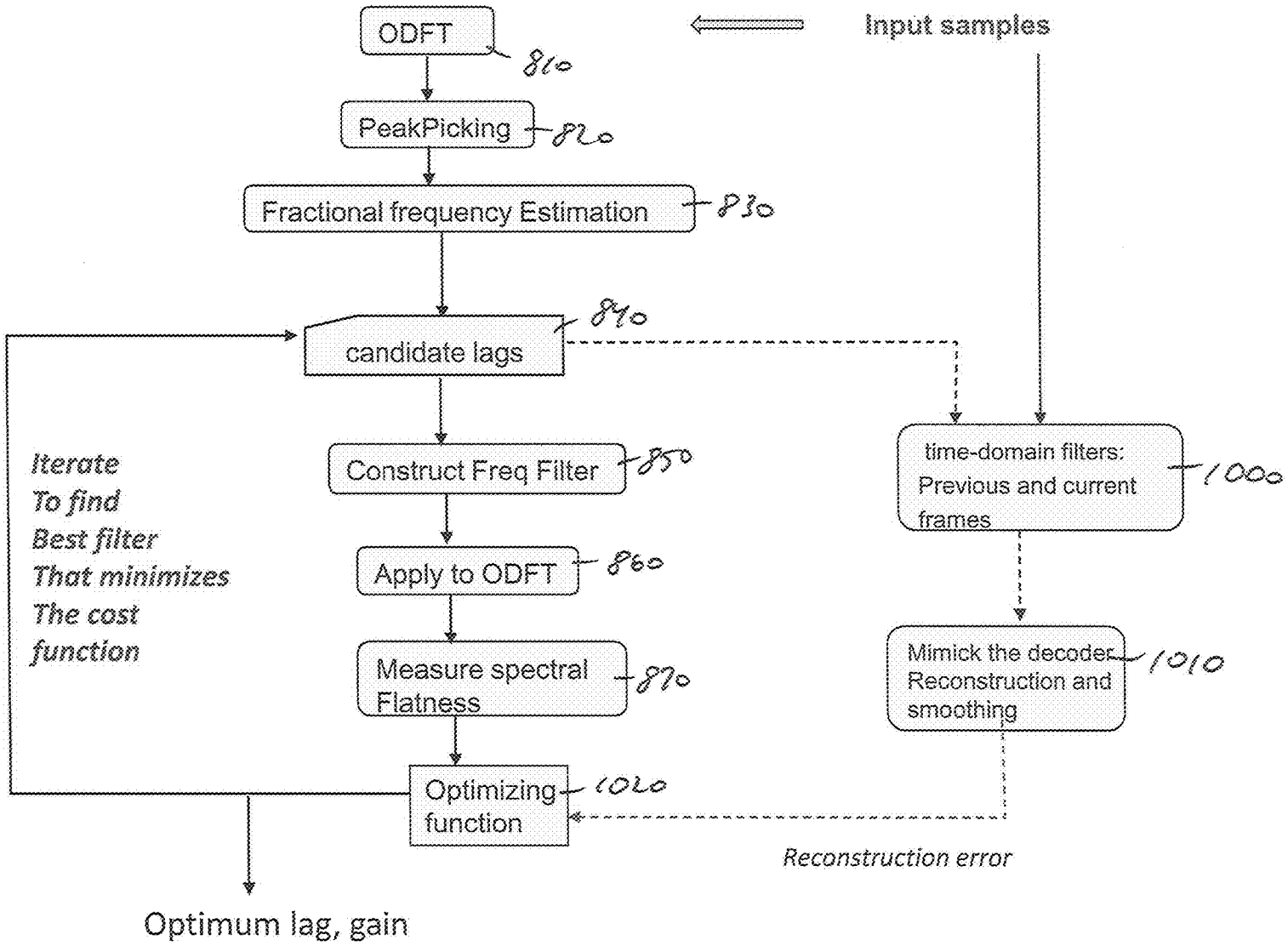
FIG. 10 illustrates an alternate embodiment where the frequency-based spectral flatness may be combined with other factors that take into account the reconstruction error at the decoder.

FIG. 10 illustrates an alternate embodiment where the frequency-based spectral flatness may be combined with other factors that take into account the reconstruction error at the decoder. This happens for instance when 2 or more lags might have the same flatness measure. An addition factor, namely the cost of transition from the previous lag in the previous frame to each of the possible lags in the current frame, is accounted for.

In the embodiments shown in FIG. 10, the filter coefficients of the LTP are estimated once per frame. Thus, the filters (at both the encoder and decoder) are loaded with a different set of coefficients, every 10-20 msec. This may potentially cause an audible discontinuity. In order to smooth the transition in the filter outputs, various schemes might be used, for instance a cross-fading scheme.

Referring to FIG. 10, during the search for the optimal set of parameter, the filters are constructed in the time domain and applied to the input (box 1000). Similarly, in these embodiments at the decode the inverse filters of the decoder are mimicked (box 1010) and the reconstruction error between output and input is computed for each of the candidate lags. This error is then combined with the flatness measure in order to yield an optimizing function (box 1020).

Figure 11:
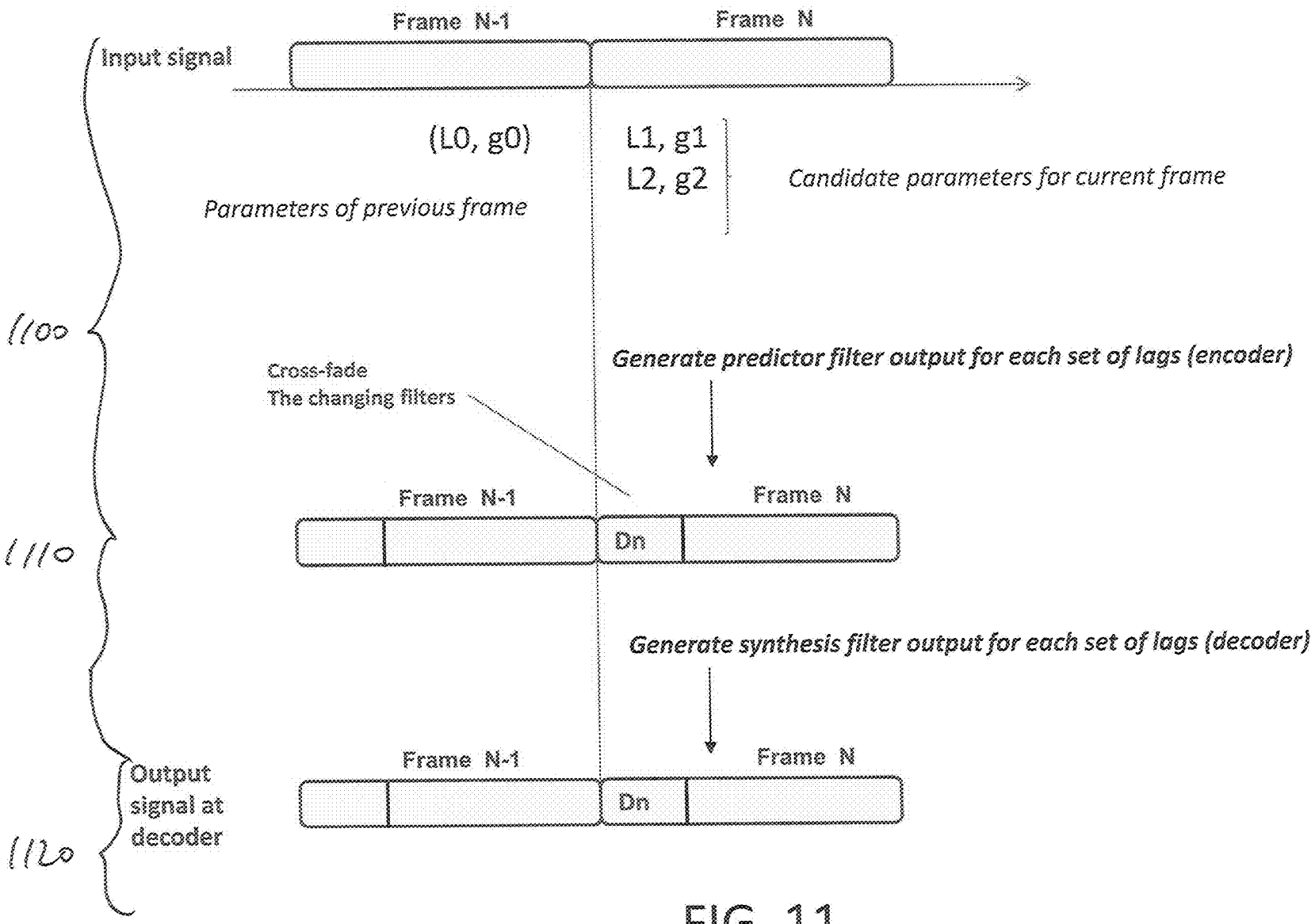
FIG. 11 illustrates two consecutive frames in time performing the operations of a portion of the embodiments shown in FIG. 10.

More specifically, FIG. 11 illustrates two consecutive frames in time performing the operations of boxes 1000 and 1010 in FIG. 10. As shown in FIG. 11, in section 1100 different set of candidate filter coefficients are shown for each frame (Frame N−1 and Frame N). As shown in section 1110, in order to smooth the transitions, the filter outputs are cross faded during the time Dn. In the current frame (Frame N), there may be 2 possible filter sets to choose from. Each set is applied to the current filter, and the cross fading operation is done for the encoder-side (shown in section 1110) and the decoder side (shown in section 1120). The resulting output is compared to the original output. The set of coefficients set is chosen based on minimizing this reconstruction error.

Extending to an Order K Predictor

For higher-order predictors, estimating the multiple taps requires an inverse matrix operation, which, in practice is not guaranteed. Thus, it is often desirable to estimate a center (or single) tap (L) only and then find a way to select the side taps from a limited sets, based on some criteria of optimality. Some of the common solutions in practical systems, are to provide a pre-computed table of filter shapes and convolve one of these with the single-tap filter computed above. For instance, if the filter shapes are 3 taps each, this will result in a $3^{rd}$ order predictor, as illustrated in FIG. 12.

Figure 12:
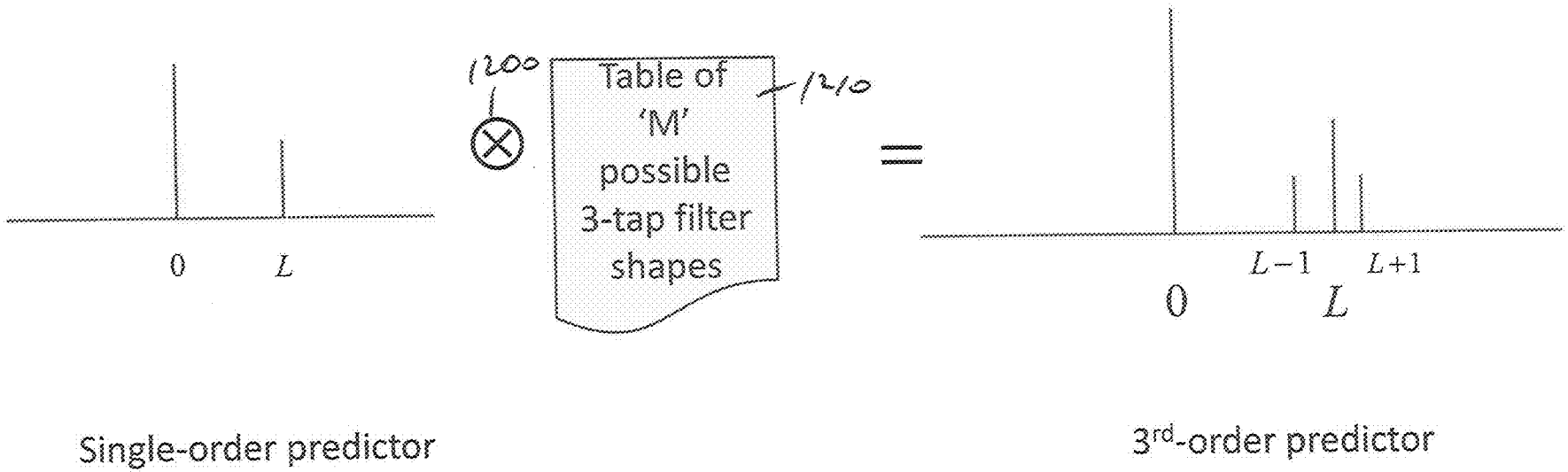
FIG. 12 illustrates converting a single-tap predictor into a 3rd order predictor.

FIG. 12 illustrates converting a single-tap predictor into a 3rd order predictor. Referring to FIG. 12, a single-order predictor is convolved 1200 with a one of the possible filter shapes from a table 1210 to yield a 3rd order predictor. In these embodiments, a table of M possible filter shapes is used, and the selection is done based on minimizing the output energy of the resulting residual. The table of M shapes is created offline, based on matching the spectral envelop of various audio content. Once a 1-tap filter is determined as explained above, each of the 'M' filter shapes is convolved to create a k-th order filter. The filter is applied to the input signal and the energy of the residual (output) of the filter is computed. The shape that minimizes the energy is chosen as the optimum. The decision is further smoothed, for instance with a hysteresis, in order not to cause large changes in signal energy.

IV. Alternate Embodiments and Exemplary Operating Environment

Alternate embodiments of the frequency domain long-term prediction system and method are possible. Many other variations than those described herein will be apparent from this document. For example, depending on the embodiment, certain acts, events, or functions of any of the methods and algorithms described herein can be performed in a different sequence, can be added, merged, or left out altogether (such that not all described acts or events are necessary for the practice of the methods and algorithms). Moreover, in certain embodiments, acts or events can be performed concurrently, such as through multi-threaded processing, interrupt processing, or multiple processors or processor cores or on other parallel architectures, rather than sequentially. In addition, different tasks or processes can be performed by different machines and computing systems that can function together.

The various illustrative logical blocks, modules, methods, and algorithm processes and sequences described in connection with the embodiments disclosed herein can be implemented as electronic hardware, computer software, or combinations of both. To clearly illustrate this interchangeability of hardware and software, various illustrative components, blocks, modules, and process actions have been described above generally in terms of their functionality. Whether such functionality is implemented as hardware or software depends upon the particular application and design constraints imposed on the overall system. The described functionality can be implemented in varying ways for each particular application, but such implementation decisions should not be interpreted as causing a departure from the scope of this document.

The various illustrative logical blocks and modules described in connection with the embodiments disclosed herein can be implemented or performed by a machine, such as a general purpose processor, a processing device, a computing device having one or more processing devices, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor and processing device can be a microprocessor, but in the alternative, the processor can be a controller, microcontroller, or state machine, combinations of the same, or the like. A processor can also be implemented as a combination of computing devices, such as a combination of a DSP and a microprocessor, a plurality of microprocessors, one or more microprocessors in conjunction with a DSP core, or any other such configuration.

Embodiments of the frequency domain long-term prediction system and method described herein are operational within numerous types of general purpose or special purpose computing system environments or configurations. In general, a computing environment can include any type of computer system, including, but not limited to, a computer system based on one or more microprocessors, a mainframe computer, a digital signal processor, a portable computing device, a personal organizer, a device controller, a computational engine within an appliance, a mobile phone, a desktop computer, a mobile computer, a tablet computer, a smartphone, and appliances with an embedded computer, to name a few.

Such computing devices can be typically be found in devices having at least some minimum computational capability, including, but not limited to, personal computers, server computers, hand-held computing devices, laptop or mobile computers, communications devices such as cell phones and PDA's, multiprocessor systems, microprocessor-based systems, set top boxes, programmable consumer electronics, network PCs, minicomputers, mainframe computers, audio or video media players, and so forth. In some embodiments the computing devices will include one or more processors. Each processor may be a specialized microprocessor, such as a digital signal processor (DSP), a very long instruction word (VLIW), or other microcontroller, or can be conventional central processing units (CPUs) having one or more processing cores, including specialized graphics processing unit (GPU)-based cores in a multi-core CPU.

The process actions of a method, process, block, or algorithm described in connection with the embodiments disclosed herein can be embodied directly in hardware, in software executed by a processor, or in any combination of the two. The software can be contained in computer-readable media that can be accessed by a computing device. The computer-readable media includes both volatile and non-volatile media that is either removable, non-removable, or some combination thereof. The computer-readable media is used to store information such as computer-readable or computer-executable instructions, data structures, program modules, or other data. By way of example, and not limitation, computer readable media may comprise computer storage media and communication media.

Computer storage media includes, but is not limited to, computer or machine readable media or storage devices such as Bluray discs (BD), digital versatile discs (DVDs), compact discs (CDs), floppy disks, tape drives, hard drives, optical drives, solid state memory devices, RAM memory, ROM memory, EPROM memory, EEPROM memory, flash memory or other memory technology, magnetic cassettes, magnetic tapes, magnetic disk storage, or other magnetic storage devices, or any other device which can be used to store the desired information and which can be accessed by one or more computing devices.

Software can reside in the RAM memory, flash memory, ROM memory, EPROM memory, EEPROM memory, registers, hard disk, a removable disk, a CD-ROM, or any other form of non-transitory computer-readable storage medium, media, or physical computer storage known in the art. An exemplary storage medium can be coupled to the processor such that the processor can read information from, and write information to, the storage medium. In the alternative, the storage medium can be integral to the processor. The processor and the storage medium can reside in an application specific integrated circuit (ASIC). The ASIC can reside in a user terminal. Alternatively, the processor and the storage medium can reside as discrete components in a user terminal.

The phrase "non-transitory" as used in this document means "enduring or long-lived". The phrase "non-transitory computer-readable media" includes any and all computer-readable media, with the sole exception of a transitory, propagating signal. This includes, by way of example and not limitation, non-transitory computer-readable media such as register memory, processor cache and random-access memory (RAM).

The phrase "audio signal" is a signal that is representative of a physical sound. One way in which the audio signal is constructed by capturing physical sound. The audio signal is played back on a playback device to generate physical sound such that audio content can be heard by a listener. A playback device may be any device capable of interpreting and converting electronic signals to physical sound.

Retention of information such as computer-readable or computer-executable instructions, data structures, program modules, and so forth, can also be accomplished by using a variety of the communication media to encode one or more modulated data signals, electromagnetic waves (such as carrier waves), or other transport mechanisms or communications protocols, and includes any wired or wireless information delivery mechanism. In general, these communication media refer to a signal that has one or more of its characteristics set or changed in such a manner as to encode information or instructions in the signal. For example, communication media includes wired media such as a wired network or direct-wired connection carrying one or more modulated data signals, and wireless media such as acoustic, radio frequency (RF), infrared, laser, and other wireless media for transmitting, receiving, or both, one or more modulated data signals or electromagnetic waves. Combinations of the any of the above should also be included within the scope of communication media.

Further, one or any combination of software, programs, computer program products that embody some or all of the various embodiments of the transform-based codec and method with energy smoothing described herein, or portions thereof, may be stored, received, transmitted, or read from any desired combination of computer or machine readable media or storage devices and communication media in the form of computer executable instructions or other data structures.

Embodiments of the frequency domain long-term prediction system and method described herein may be further described in the general context of computer-executable instructions, such as program modules, being executed by a computing device. Generally, program modules include routines, programs, objects, components, data structures, and so forth, which perform particular tasks or implement particular abstract data types. The embodiments described herein may also be practiced in distributed computing environments where tasks are performed by one or more remote processing devices, or within a cloud of one or more devices, that are linked through one or more communications networks. In a distributed computing environment, program modules may be located in both local and remote computer storage media including media storage devices. Still further, the aforementioned instructions may be implemented, in part or in whole, as hardware logic circuits, which may or may not include a processor.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

While the above detailed description has shown, described, and pointed out novel features as applied to various embodiments, it will be understood that various omissions, substitutions, and changes in the form and details of the devices or algorithms illustrated can be made without departing from the spirit of the disclosure. As will be recognized, certain embodiments of the inventions described herein can be embodied within a form that does not provide all of the features and benefits set forth herein, as some features can be used or practiced separately from others.

Moreover, although the subject matter has been described in language specific to structural features and methodological acts, it is to be understood that the subject matter defined in the appended claims is not necessarily limited to the specific features or acts described above. Rather, the specific features and acts described above are disclosed as example forms of implementing the claims.

What is claimed is:

1. An audio coding system for encoding an audio signal, comprising:

a frequency transformation unit that represents the windowed time signal in a frequency domain to obtain a frequency transformation of the audio signal;

an optimal long-term predictor estimation unit that estimates long-term predictor coefficients based on an analysis of the frequency transformation and a criteria of optimality in the frequency domain;

a long-term predictor that filters the audio signal in the time domain, wherein the long-term predictor is an adaptive filter with coefficients that are the long-term predictor coefficients estimated from the analysis performed by the optimal long-term predictor estimation unit in the frequency domain;

a quantization unit that quantizes frequency transform coefficients of a windowed frame to be encoded to generate quantized frequency transform coefficients; and an encoded signal containing the quantized frequency transform coefficients, and where the encoded signal is a representation of the audio signal.

2. The audio coding system of claim 1, wherein the optimal long-term predictor estimation unit further comprises estimating the optimal long-term linear predictor based on an analysis of a quantization error from the quantization unit.

3. The audio coding system of claim 1, further comprising:

a filter shapes table of pre-determined filter shapes used to extend a 1-tap long-term linear predictor into a k-th order long-term linear predictor; and an estimation selection unit that selects the optimal filter shape from the filter shapes table.

4. The audio coding system of claim 3, further comprising the optimal filter shape that is selected by minimizing an energy of an output of the k-th order long-term linear predictor.

5. A method for encoding an audio signal, comprising:

generating a frequency transformation for the audio signal, the frequency transform representing a windowed time signal in a frequency domain;

estimating long-term predictor coefficients based on an analysis of the frequency transformation and a criteria of optimality in the frequency domain;

filtering the audio signal in the time domain using a long-term linear predictor, wherein the long-term linear predictor is an adaptive filter with coefficients that are the long-term predictor coefficients that were estimated from the analysis in the frequency domain;

quantizing frequency transform coefficients of a windowed frame to be encoded to generate quantized frequency transform coefficients; and constructing an encoded signal containing the quantized frequency transform coefficients, wherein the encoded signal is a representation of the audio signal.

6. The method of claim 5, further comprising determining adaptive filter coefficients for the long-term linear predictor based on a frequency analysis of a windowed time signal of the audio signal.

7. The method of claim 5, further comprising estimating the optimal long-term linear predictor based on both the analysis of the frequency transformation and a quantization error from quantization of the frequency transformation coefficients.

8. The method of claim 5, further comprising:

extending a 1-tap long-term linear predictor into a k-th order long-term linear using a predictor filter shapes table containing pre-determined filter shapes; and selecting an optimal filter shape from the predictor filter shapes table for use in the optimal long-term linear predictor.

9. The method of claim 8, wherein selecting the optimal filter shape further comprises selecting a filter shape from the predictor filter shapes table that minimizes an energy of an output of the k-th order long-term linear predictor.

10. The method of claim 5, wherein the long-term linear predictor is a 1-tap long-term linear predictor and further comprising estimating lag and gain parameters for the 1-tap long-term linear predictor.

11. The method of claim 10, further comprising:

determining dominant peaks in a frequency magnitude spectrum corresponding to the dominant harmonic components in the windowed time signal and computing a fractional frequency for each of the dominant peaks;

constructing a set of candidate filters in the frequency domain based on a subset of the dominant peaks and applying this set of candidate filters to the frequency magnitude spectrum to generate a resultant transform spectrum; and computing the criteria of optimality.

12. The method of claim 11, further comprising wherein the frequency-based criteria of optimality is the spectral flatness measure of the resulting spectrum after applying the candidate filter:

selecting the optimal filter shape that maximizes the criteria of optimality;

converting the lag and gain parameters determined in a frequency analysis into a time-domain equivalent; and applying, in the time domain to the audio signal, the optimal long-term linear predictor containing the lag and gain parameters, wherein the optimal filter shape contains the lag and gain parameters.

13. The method of claim 11, further comprising quantizing the resultant transform spectrum using a scalar or a vector quantizer;

generating a measure of the quantization error for a selected bit rate; and estimating the optimal long-term linear predictor based on a combination of a measure of the quantization error and spectral flatness measure.

14. The method of claim 13, further comprising imposing an upper limit on a gain of the optimal long-term linear predictor using the quantization error and a frame tonality measure.

15. The method of claim 14, further comprising estimating the optimal long-term linear predictor based on minimizing reconstruction signal error at the decoder.

16. A method for encoding an audio signal, comprising:

filtering the audio signal using a long-term linear predictor, wherein the long-term linear predictor is an adaptive filter;

generating a frequency transformation for the audio signal, the frequency transform representing a windowed time signal in a frequency domain;

estimating an optimal long-term linear predictor based on an analysis of the frequency transformation and a criteria of optimality in the frequency domain;

extending a 1-tap long-term linear predictor into a k-th order long-term linear using a predictor filter shapes table containing pre-determined filter shapes;

selecting an optimal filter shape from the predictor filter shapes table that minimizes an energy of an output of the k-th order long-term linear predictor for use in the optimal long-term linear predictor;

quantizing frequency transform coefficients of a windowed frame to be encoded to generate quantized frequency transform coefficients; and constructing an encoded signal containing the quantized frequency transform coefficients, wherein the encoded signal is a representation of the audio signal.

17. The method of claim 16, further comprising determining adaptive filter coefficients for the long-term linear predictor based on a frequency analysis of a windowed time signal of the audio signal.

18. The method of claim 16, further comprising estimating the optimal long-term linear predictor based on both the analysis of the frequency transformation and a quantization error from quantization of the frequency transformation coefficients.

* * * * *